US008081145B2

(12) United States Patent
Ronkholz et al.

(10) Patent No.: US 8,081,145 B2
(45) Date of Patent: Dec. 20, 2011

(54) DISPLAY DEVICE

(75) Inventors: Karl-Heinz Ronkholz, Krefeld (DE); Rolf Aengenendt, Krefeld (DE)

(73) Assignee: Lumino Licht Elektronik GmbH, Krefeld (DE)

( * ) Notice: Subject to any disclaimer, the term of this patent is extended or adjusted under 35 U.S.C. 154(b) by 1014 days.

(21) Appl. No.: 11/264,822

(22) Filed: Nov. 1, 2005

(65) Prior Publication Data

US 2007/0097015 A1 May 3, 2007

(51) Int. Cl.
*G09G 3/32* (2006.01)

(52) U.S. Cl. ..... 345/82; 345/1.1; 345/83; 345/183; 362/812

(58) Field of Classification Search ..... 345/1.1, 345/183, 82–83; 362/812
See application file for complete search history.

(56) References Cited

U.S. PATENT DOCUMENTS

| | | | | |
|---|---|---|---|---|
| 5,722,767 | A * | 3/1998 | Lin | 362/249 |
| 5,900,850 | A * | 5/1999 | Bailey et al. | 345/55 |
| 6,659,623 | B2 * | 12/2003 | Friend | 362/249 |
| 6,831,306 | B1 * | 12/2004 | Uehran | 257/100 |
| 6,883,950 | B2 * | 4/2005 | Adachi et al. | 362/555 |
| 7,032,949 | B1 * | 4/2006 | Wang et al. | 296/97.9 |
| 2003/0167666 | A1 * | 9/2003 | Close, Jr. | 40/452 |
| 2004/0174717 | A1 * | 9/2004 | Adachi et al. | 362/555 |
| 2005/0030765 | A1 * | 2/2005 | Southard et al. | 362/559 |
| 2006/0152437 | A1 * | 7/2006 | Ogawa | 345/35 |
| 2006/0167990 | A1 * | 7/2006 | Tobiasen et al. | 709/204 |
| 2006/0227003 | A1 * | 10/2006 | Ven | 340/815.45 |
| 2006/0279493 | A1 * | 12/2006 | Syrstad | 345/82 |
| 2006/0292461 | A1 * | 12/2006 | Shives et al. | 430/7 |
| 2007/0064421 | A1 * | 3/2007 | Baba | 362/231 |
| 2007/0132707 | A1 * | 6/2007 | Choi et al. | 345/102 |
| 2008/0060234 | A1 * | 3/2008 | Chou et al. | 40/452 |
| 2008/0060238 | A1 * | 3/2008 | Chiang et al. | 40/564 |

FOREIGN PATENT DOCUMENTS

| | | |
|---|---|---|
| DE | 4039034 | 6/1992 |
| DE | 10026285 | 11/2001 |
| DE | 10064534 | 6/2002 |
| EP | 0 997 865 | 5/2000 |
| EP | 1 293 955 | 3/2003 |
| JP | 11259019 A * | 9/1999 |

* cited by examiner

*Primary Examiner* — Ke Xiao
(74) *Attorney, Agent, or Firm* — Fish & Richardson P.C.

(57) ABSTRACT

A display device for so-called façade displays is proposed which comprises several supports that can be affixed to the façade of an edifice, in particular a building, on the outside or the inside; a plurality of groups of light-emitting diodes that are provided on the several supports and serve as picture points of the display device; and a control unit for activating the plurality of the groups of light-emitting diodes. The display device distinguishes itself by the fact that the several supports are each formed as an elongated profile body, which comprises a recess extending in the longitudinal direction of the profile body; that the plurality of groups of light-emitting diodes are mounted on several circuit boards, the several circuit boards each being integrated or incorporated in a protective mass; and that the several circuit boards are inserted in such a way into the recesses of the several supports that the plurality of groups of light-emitting diodes project at least partly from the recesses or face at least the outer side of the respective support.

31 Claims, 2 Drawing Sheets

DISPLAY DEVICE

BACKGROUND OF THE INVENTION

1. Field of the Invention

The present invention relates to a display device, in particular a display device for a so-called façade display.

2. Technical Background

A façade display is known from DE 40 39 034 A1, in which the façade of the building remains unchanged and that can be installed at relatively low cost. The display device disclosed in DE 40 39 034 A1 uses at least part of the front of a building with regularly disposed windows or groups of windows, which are used as picture points of the display, and light sources allocated to each window that are mounted in or on the building, which can be selectively switched. As is represented in the single Fig. of this document, the current time is displayed in digital writing by means of the selectively illuminated windows of the front of the building. Since the individual picture points are in each case formed by a complete window in this façade display, the possibilities of the information to be displayed with this façade display are limited.

Moreover, DE 100 26 285 A1 of the present inventors describes a façade display, in which a plurality of illumination units can be affixed to the façade of a building for instance by means of a reticulate wire mesh. Due to this, the illumination units can be flexibly disposed on the façade of the building so that a great variability as regards the design and the display possibilities is ensured.

In a further development of the display device known from DE 100 26 285 A1, DE 100 64 534 A1 of the present inventors suggests a display device for façade displays, in which the groups of light-emitting diodes that serve as picture points are affixed on several supports which, in turn, are mounted on a fastening device affixed to the façade of a building. For instance, the supports are designed in the form of lamellae which are affixed to the fastening device like a sunshade blind.

Similar constructions with special support systems are also disclosed by EP 0 997 865 A2 and EP 1 293 955 A2.

SUMMARY OF THE INVENTION

The present invention is based on the object of providing a display device for façade displays which, on the one hand, ensures a high flexibility of the display possibilities and, at the same time, a secure and durable attachment of the groups of light-emitting diodes serving as picture points is ensured.

This object is attained by a display device comprising several supports which, for instance, may be affixed to the façade of a building; a plurality of groups of light-emitting diodes which are provided on the several supports and serve as picture points of the display device; and a control unit for activating the plurality of groups of light-emitting diodes. The several supports are each formed as an elongated profile body which has a recess extending in the longitudinal direction of the profile body. The plurality of groups of light-emitting diodes are mounted on several circuit boards, the several circuit boards each being integrated and/or incorporated in a protective mass. The several circuit boards are inserted into the recesses of the several supports so that the plurality of the groups of light-emitting diodes project at least party from the recesses or face at least the outer side of the respective support.

The display device of the present invention combines the simple and flexible attachment of a plurality of groups of light-emitting diodes that serve as picture points to a façade by means of several supports with a safe and durable attachment of the groups of light-emitting diodes and their electronics components required for the activation on the circuit boards by incorporating the circuit boards in the protective mass and introducing them into the longitudinal recesses of the supports.

In a further development of the invention each of the several supports also comprises at least one fastening device with which the supports can be mounted on a support frame, which, in turn, is affixed to the façade. The several supports may be mounted on the support frame with the at least one fastening device e.g. by means of clamping, interference fit, bolting, gluing, welding or the like.

In a further development of the invention several circuit boards are each disposed in series in the recess of a support. In this case, the several circuit boards should be coupled in the recess of a support by means of connecting elements for electrical connection and data transmission, the connecting elements being preferably pin-and-socket connectors and the circuit boards having preferably corresponding terminals in the area of their front sides.

In a still further development of the invention the circuit boards have terminals for electric connection with and data transmission from an external control unit in the area of at least one of their front sides.

Preferably, the several supports are formed in the shape of lamellae which may e.g. also be mounted in the manner of a sunshade blind in horizontal or vertical alignment, but basically in an optional alignment or even different alignments. The several supports may be mountable in such a way that they are pivotable about their longitudinal axes between an operating position and a non-operating position of the display device or also of the sunshade blind device.

The distance between the supports, on the one hand, and the distance between the groups of light-emitting diodes of the circuit boards, on the other, may be optionally chosen in such a way that the are equal to or different from each other.

BRIEF DESCRIPTION OF THE DRAWINGS

The above and further features and advantages of the invention can be better understood from the following description of a preferred non-limiting example of embodiment with reference to the attached drawings, in which.

PREFERRED EMBODIMENT OF THE INVENTION

Figure 1:
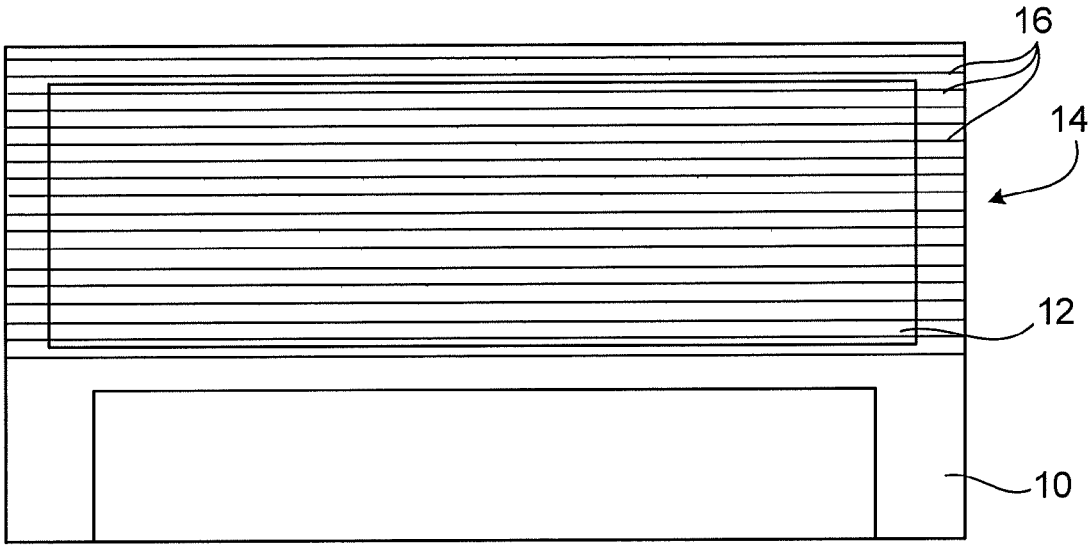
FIG. 1 shows a greatly schematic front view of the façade of a building with a display device according to the present invention.

As is represented in FIG. 1 in a greatly simplified fashion, the display device 14 of the present invention is in particular suited as a so-called façade display which can be mounted on a façade 10 of an edifice, in particular a building, e.g. in front of a large-surface window front 10, to display information. Basically, optional information can be represented on the façade display, in particular both alphanumerical and graphical symbols, both stills, light writing and real time videos and the like. The display device 14 of the invention is of course not restricted to specific types or sizes of edifices or to the presence of large-surface window fronts 12, even if the invention is explained in greater detail in the following taking the façade of a building with a large-surface window front as an example.

The display device 14 according to the invention comprises several supports 16 which are provided in a horizontal alignment on the façade of the building in the illustration of FIG. 1. Optionally it is also conceivable to attach these supports 16 to the façade 10 in vertical alignment. However, basically it is possible to mount the supports on the façade 10 at an optional angle or even in different alignment.

The individual supports 16 are formed as elongate profile bodies 18 e.g. in the form of lamellae like e.g. a sunshade blind. The profile bodies 18 which are to be affixed to the outer side or inner side of the façade 10 of the building consist e.g. of a metal such as aluminum and/or its alloy or a weather-resistant synthetic material.

Figure 2:
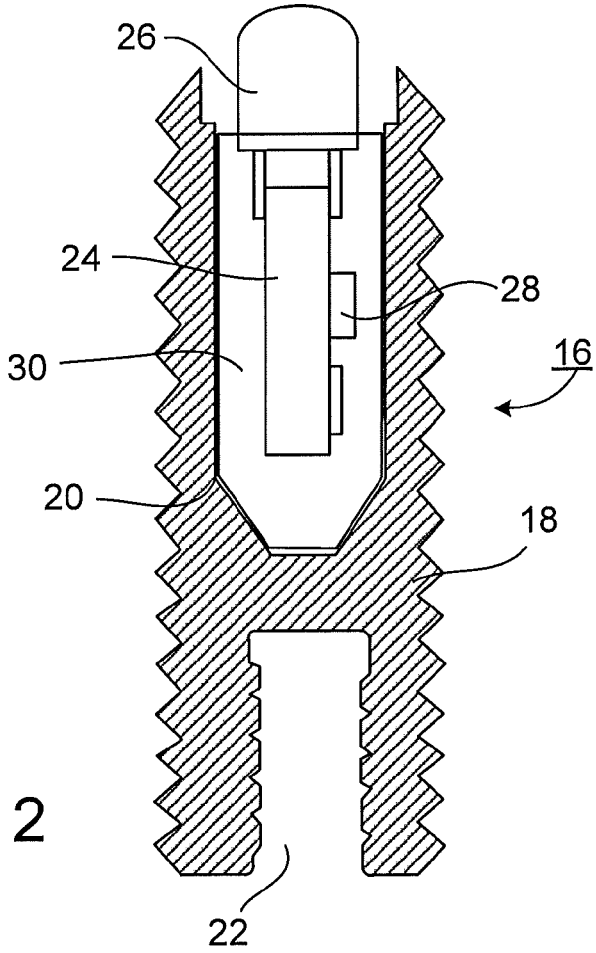
FIG. 2 shows a cross-section through a support of the display device with attached groups of light-emitting diodes according to a preferred example of embodiment of the present invention.

As is schematically represented in FIG. 2, the elongate profile body 18 has a first recess 20 at a narrow longitudinal side, which extends in the longitudinal direction of the profile body 18 substantially along its entire length. The first recess 20 is provided on the longitudinal side of the profile body 18, which does not face the façade 10 of the building in the operating position of the display device 14 so that the opening of the first recess 20 is directed away from the façade. This first recess 20 serves for receiving a circuit board 24 with several light-emitting diodes 26 and the electronics components 28 which will be explained in greater detail below by means of FIGS. 3 and 4. As can already be seen in FIG. 2 the circuit board 24 is incorporated and/or integrated in a protective mass 30, and the light-emitting diodes 26 should project at least partly from the first recess 20 of the profile body 18 or at least face the outer side of the profile body 18. The circuit board 24 with the light-emitting diodes 26 that is integrated in the protective mass 30 is firmly inserted or pushed into the first recess (e.g. by means of interference fit, gluing, locking, integration or the like). The protective mass consists e.g. of an electrically insulated material that is resistant against environmental influences.

The profile body 18 comprises e.g. a second recess 22 on the narrow longitudinal side which does not face the first recess 20, i.e. that faces the façade 10 of the building in the operating position of the display device 14. The support 16 can be attached to a support frame (not shown) by means of this second recess 22, e.g. by means of clamping, bolting or interference fit, the support frame being in turn attached to the façade 10 of the building. The support may also comprise instead of or in addition to the second recess 22 other elements as a fastening device, by means of which it can be mounted on the support frame by means of clamping, interference fit, bolting, gluing, welding or the like. Moreover, the location of the fastening device 22 is not restricted to the longitudinal side of the profile body 18 and must also not extend along the entire length of the profile body. In an especially advantageous development the supports 16 can thus be mounted on the support frame (not shown) and/or the support frame can be designed and/or disposed in such a way that the supports 16 are pivotable about their longitudinal axes between an operating position and a non-operating position of the display device 14 and/or the sunshade device.

Figure 3:
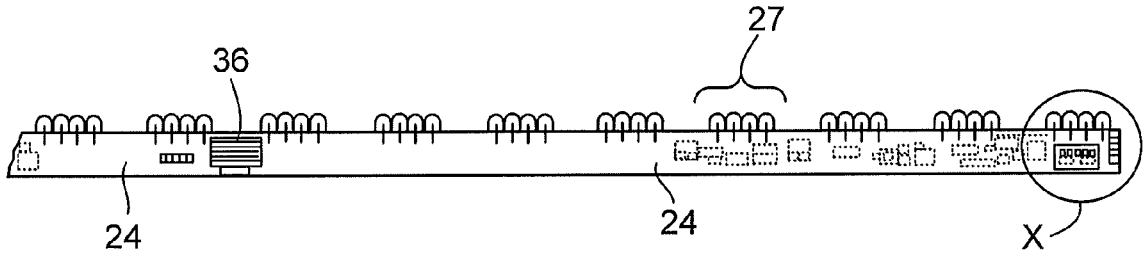
FIG. 3 shows a side view of the circuit boards built into the support of FIG. 2 in accordance with a preferred example of embodiment of the present invention.

In addition to the electronics components 28 required for the activation of the light-emitting diodes 26, several groups 27 of light-emitting diodes are provided on the circuit board 24 as is illustrated by the representation of FIG. 3. Each group 27 of light-emitting diodes consists of several preferably different-colored light-emitting diodes 26 so that picture points of optional colors can be formed. However, the present invention is not only restricted to such groups 27 of light-emitting diodes, but the groups 27 of light-emitting diodes may also only comprise one to three light-emitting diodes 26 or more than four light-emitting diodes 26, they may comprise different numbers of light-emitting diodes 26 and they must not contain any light-emitting diodes of different colors.

The distance between the individual groups 27 of light-emitting diodes on a circuit board 24 may either be chosen as being the same as or different to the distance of the supports 16 with respect to each other. In other words, the distance of the picture points in the horizontal and vertical directions may be optionally selected symmetrically or asymmetrically, which must, of course, be correspondingly taken into consideration when activating the groups 27 of light-emitting diodes by means of a control unit (not shown). The variability of the display device 14 according to the invention is still intensified by the basically optionally angular or even different alignment of the individual supports with respect to each other.

Figure 4:
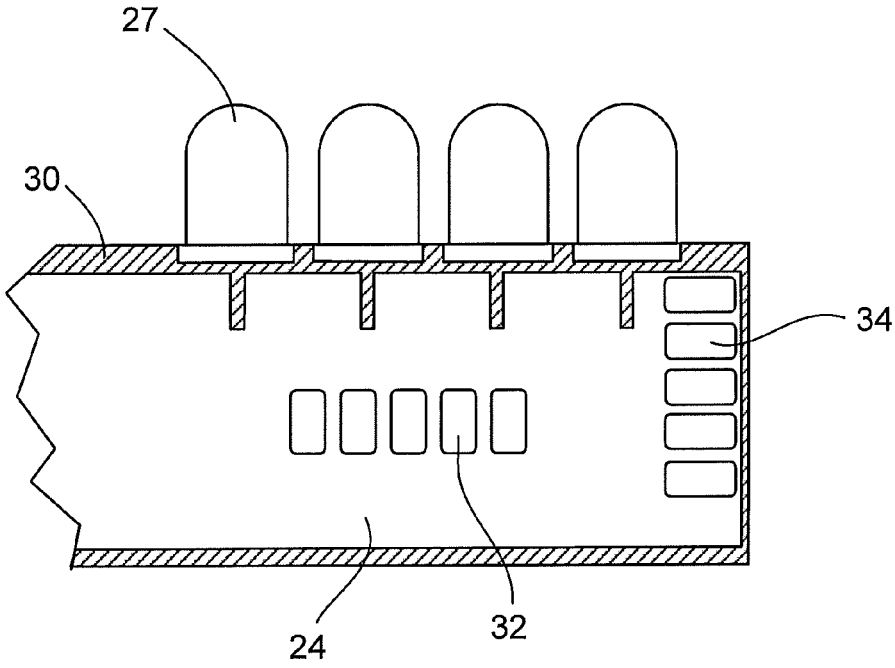
FIG. 4 shows an enlarged view of a detail of the cutout X of FIG. 3.

As is represented in the enlarged cutout X in FIG. 4, each circuit board 24 comprises several first terminals 32 in the area of its one front side (preferably on both front sides). These first terminals 32 serve for the coupling of the circuit boards 24 of the supports to the control unit (not shown) for the electrical connection and data transmission.

Moreover, the circuit board comprises further terminals 34 in the area of its front side (preferably on both front sides). These further terminals 34 serve for the coupling of several circuit boards 24 for the electrical connection and data transmission, which are disposed in series one behind the other in a support 16. The coupling is implemented via a suitable connecting element 36 such as e.g. a pin-and-socket connector. As is outlined in FIG. 3, several circuit boards 24 can thus be connected with each other in the longitudinal direction and built into a support 16. This is advantageous since the lengths of the circuit boards 24 are generally limited for manufacturing and handling reasons. However, it is likewise possible within the framework of the invention to provide the first terminals 32 and the further terminals 34 as joint terminals 32, 34.

What is claimed is:

1. A display device comprising:

several supports which can be mounted on a façade of an edifice, said supports being spaced apart from each other, allowing a person within the edifice to look out through the spacing between the supports;

a plurality of groups of light-emitting diodes which are provided on the several supports and serve as picture points of the display device; and a control unit for activating said plurality of groups of light-emitting diodes, wherein said several supports are each formed as an elongated profile body, which has a recess extending in the longitudinal direction of said profile body and having an opening, said several supports are aligned substantially parallel to each other, said plurality of groups of light-emitting diodes are mounted on several circuit boards, said several circuit boards each being integrated in a protective mass with corresponding light-emitting diodes partially protruding out of the protective mass, and said several circuit boards are inserted into the recesses of said several supports in such a way that each group of light-emitting diodes partially protrude from the protective mass and protrude at least partially from the corresponding recess beyond a farthest edge of the corresponding support, the farthest edge being the edge of the corresponding support that is farthest from a plane substantially parallel to the façade along a direction perpendicular to the plane when the support is in an operating position.

2. A display device according to claim 1, wherein each of said several supports also comprises at least one fastening device, with which said supports can be mounted on a support frame, which in turn is affixed to said façade of an edifice.

3. A display device according to claim 2, wherein said several supports are mountable by said at least one fastening device on said support frame by means of clamping, interference fit, bolting, gluing, welding or the like.

4. A display device according to claim 1, wherein in said recess of a support several circuit boards are disposed in series each.

5. A display device according to claim 4, wherein said several circuit boards in the recess of a support are coupled by means of connection elements for electrical connection and data transmission.

6. A display device according to claim 5, wherein said connection elements are pin-and-socket connectors and said circuit boards have corresponding terminals in the area of their front sides.

7. A display device according to claim 1, wherein said circuit boards have terminals for electric connection to and data transmission from the control unit in the area of at least one of their front sides.

8. A display device according to claim 1, wherein said several supports are formed in the shape of lamellae which can be mounted in a horizontal, vertical or angular alignment.

9. A display device according to claim 1, wherein the distance between said supports and the distance between said groups of light-emitting diodes of said circuit boards are optionally chosen to be equal or different.

10. A display device according to claim 1, wherein said several supports can be mounted in such a way that they are pivotable about their longitudinal axes between the operating position and a non-operating position of said display device, the light-emitting diodes being pivoted along with the supports such that the light-emitting diodes move between an operating position and a non-operating position.

11. A display device comprising:

several supports which can be mounted on a façade of an edifice, said several supports being designed in the shape of lamellae which can be mounted in a horizontal, vertical or angular alignment, said supports being spaced apart from each other, allowing a person within the edifice to look out through the spacing between the supports;

a plurality of groups of light-emitting diodes which are provided on several supports and serve as picture points of said display device; and a control unit for activating said plurality of groups of light-emitting diodes, wherein said several supports are each formed as an elongated profile body, which has a recess extending in the longitudinal direction of said profile body and having an opening, said several supports are aligned substantially parallel to each other, said plurality of groups of light-emitting diodes are mounted on several circuit boards, said several circuit boards each being integrated in a protective mass with corresponding light-emitting diodes partially protruding out of the protective mass, and said several circuit boards are inserted into the recesses of the several supports in such a way that said plurality of groups of light-emitting diodes partially protrude from the protective mass and protrude at least partially from the corresponding recess beyond a farthest edge of the corresponding support, the farthest edge being the edge of the corresponding support that is farthest from a plane substantially parallel to the façade along a direction perpendicular to the plane when the support is in an operating position.

12. A display device according to claim 11, wherein said several supports can be mounted in such a way that they are pivotable about their longitudinal axes between the operating position, and a non-operating position of said display device, the light-emitting diodes being pivoted along with the supports such that the light-emitting diodes move between an operating position and a non-operating position.

13. A display device according to claim 11, wherein each of the supports comprises at least one fastening device with which the support can be mounted on a support frame that is affixed to the façade.

14. A display device according to claim 13, wherein the supports are mounted by the at least one fastening device on the support frame by means of at least one of clamping, interference fit, bolting, gluing, or welding.

15. A display device according to claim 11, wherein for each of the supports, several circuit boards are disposed in series in the recess of the support.

16. A display device according to claim 15, wherein the several circuit boards in the recess of a support are coupled by means of connection elements for electrical connection and data transmission.

17. A display device according to claim 11, wherein the supports are pivotable about their longitudinal axes between the operating position and a non-operating position of the display device.

18. A display device comprising:

a plurality of supports that can be mounted on a façade of an edifice, each of the supports being formed as an elongated profile body having a recess extending in a longitudinal direction of the support and having an opening, the supports being spaced apart from each other, allowing a person within the edifice to look out through the spacing between the supports;

circuit boards each integrated in a protective mass, the circuit boards and corresponding protective mass being mounted into the recesses of the elongated supports; and light-emitting diodes mounted on the circuit boards, the light-emitting diodes partially protruding from the protective mass, protrude at least partially from the corresponding recess beyond a farthest edge of the corresponding support, and being visible to an audience of the display device through the opening when the supports are in an operation position, the light-emitting diodes being arranged in an array to enable the display device to show a variety of images, the farthest edge being the edge of the support that is farthest from a plane substantially parallel to the façade along a direction perpendicular to the plane when the support is in the operating position;

wherein the plurality of supports are aligned substantially parallel to each other and are mounted in such a way that each support is pivotable about its longitudinal axis between the operating position and a non-operating position, the light-emitting diodes being pivoted along with the supports such that the light-emitting diodes move between an operating position and a non-operating position.

19. The display device of claim 18, comprising a control unit for activating the light-emitting diodes.

20. The display device of claim 1 in which the supports are formed in the shape of lamellae, each support has a first narrower longitudinal side and a wider longitudinal side, and the recess extends in the narrower longitudinal side of the support.

21. The display device of claim 20 in which each support has a second recess extending in a second narrower longitudinal side, the second recess faces away from the first recess into which the circuit boards are inserted, the first recess and the second recess are aligned along a same axis, and the support is attached to a support frame by using the second recess.

22. The display device of claim 1 in which the supports are mounted in a vertical alignment using Earth as reference.

23. The display device of claim 6 in which the pin- and socket connectors are configured to enable a pin of a first circuit board to be connected to a socket of a second, adjacent circuit board, the first and second circuit boards both being inserted into the recess of a same support.

24. The display device of claim 11 in which each support has a first narrower longitudinal side and a wider longitudinal side, and the recess extends in the narrower longitudinal side of the support.

25. The display device of claim 24 in which each support has a second recess extending in a second narrower longitudinal side, the second recess faces away from the first recess into which the circuit boards are inserted, the first recess and the second recess are aligned along a same axis, and the support is attached to a support frame by using the second recess.

26. The display device of claim 11 in which the supports are mounted in a vertical alignment using Earth as reference.

27. The display device of claim 16 in which the connection elements comprise pin- and socket connectors that are configured to enable a pin of a first circuit board to be connected to a socket of a second, adjacent circuit board, the first and second circuit boards both being inserted into the recess of a same support.

28. The display device of claim 18 in which the supports are formed in the shape of lamellae, each support has a first narrower longitudinal side and a wider longitudinal side, and the recess extends in the narrower longitudinal side of the support.

29. The display device of claim 28 in which each support has a second recess extending in a second narrower longitudinal side, the second recess faces away from the first recess into which the circuit boards are inserted, the first recess and the second recess are aligned along a same axis, and the support is attached to a support frame by using the second recess.

30. The display device of claim 18 in which the supports are mounted in a vertical alignment using Earth as reference.

31. The display device of claim 18 in which the circuit boards in the recess of a support are coupled by pin-and-socket connectors for electrical connection and data transmission, and the pin-and-socket connectors are configured to enable a pin of a first circuit board to be connected to a socket of a second, adjacent circuit board, the first and second circuit boards both being inserted into the recess of a same support.

* * * * *